US007477273B2

(12) United States Patent
Jin

(10) Patent No.: US 7,477,273 B2
(45) Date of Patent: Jan. 13, 2009

(54) METHOD AND DEVICE FOR ADJUSTING ALIGNMENT OF IMAGE FORMING APPARATUS

(75) Inventor: Song-baik Jin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 418 days.

(21) Appl. No.: 11/332,314

(22) Filed: Jan. 17, 2006

(65) Prior Publication Data

US 2006/0158505 A1 Jul. 20, 2006

(30) Foreign Application Priority Data

Jan. 17, 2005 (KR) ..... 10-2005-0004147

(51) Int. Cl.
*B41J 2/32* (2006.01)
*B41J 3/60* (2006.01)

(52) U.S. Cl. ..... 347/171

(58) Field of Classification Search ..... 347/19, 347/171, 172, 174, 175, 176; 400/188
See application file for complete search history.

(56) References Cited

FOREIGN PATENT DOCUMENTS

| | | |
|---|---|---|
| CN | 1521002 A | 11/2006 |
| JP | 57-069066 | 4/1982 |
| JP | 08-011309 | 1/1996 |
| JP | 2000-127360 | 5/2000 |
| JP | 2001-199055 | 7/2001 |
| JP | 2002-036612 | 2/2002 |
| JP | 2002-144613 | 5/2002 |
| KR | 10-2004-0073730 | 8/2004 |

*Primary Examiner*—Huan H Tran
(74) *Attorney, Agent, or Firm*—Roylance, Abrams, Berdo & Goodman, LLP

(57) ABSTRACT

A method and device for adjusting the alignment of a thermal print image forming apparatus for printing an image by applying heat to a medium using two thermal print heads is provided. The method includes printing first and second patterns by applying heat to the medium using the first and second thermal print heads simultaneously. The first and second patterns are sensed using a sensor, and the distance between the first and second thermal print heads is calculated by using the difference between the print positions of the sensed first and second patterns. The alignment between the print positions of the first and second thermal print heads is adjusted using the calculated distance. Accordingly, the distance between the two thermal print heads is accurately measured using the two simultaneously printed patterns, and the alignment of the image forming apparatus is conveniently and precisely adjusted using the measured distance between the thermal print heads. Thus, optimum print quality can be achieved.

18 Claims, 6 Drawing Sheets

METHOD AND DEVICE FOR ADJUSTING ALIGNMENT OF IMAGE FORMING APPARATUS

CROSS-REFERENCE TO RELATED PATENT APPLICATIONS

This application claims the benefit under 35 U.S.C. § 119 (*a*) of Korean Patent Application No. 10-2005-0004147, filed on Jan. 17, 2005, in the Korean Intellectual Property Office, the entire disclosure of which is hereby incorporated by reference.

BACKGROUND OF THE INVENTION

1. Field of the Invention

The present invention relates to a thermal transfer image forming apparatus that prints an image by applying heat to a medium using two thermal print heads. More particularly, the present invention relates to a method and device for adjusting the alignment of an image forming apparatus using the distance between two thermal print heads which has been accurately measured using two patterns printed by simultaneously heating a medium using the two thermal print heads.

2. Description of the Related Art

In general, an image forming apparatus converts a document, which a user creates using an application program, or an image, which a user obtains using a digital, camera or the like, into encoded data and outputs the data to media in a visible form.

A thermal transfer image forming apparatus, which is used to obtain a high quality printed image, forms an image by heating an ink ribbon in contact with a medium using a thermal print head and transferring the ink to the medium, or by applying heat to a medium on which an ink layer is formed to reveal a predetermined color in response to heat.

A thermal image forming apparatus may use two or more thermal printer heads to heat a medium and print a color image. If the thermal print heads face each other with the medium between them, such as an upper thermal print head and a lower print head, the print quality is degraded due to thermal interference between the thermal print heads or an increase of temperature in a specific position. Therefore, the thermal print heads are positioned apart from each other.

When the thermal print heads are positioned apart from each other, however, the positions where the thermal print heads apply heat to print a dot of color are not precisely matched. Therefore, accurate color may not be achieved, and the print quality is degraded.

Accordingly, there is a need for an improved method and device for forming an image using two thermal print heads.

SUMMARY OF THE INVENTION

An aspect of the present invention is to address at least the above problems and/or disadvantages and to provide at least the advantages described below. Accordingly, an aspect of the present invention is to provide a method and device for adjusting the alignment of the image forming apparatus using the distance between two thermal print heads which has been accurately measured using two patterns printed by simultaneously heating a medium using the two thermal print heads.

According to an aspect of the present invention, a method of adjusting the alignment of an image forming apparatus using first and second thermal print heads that apply heat to a medium to print an image is provided. The method comprises the steps of printing first and second patterns by applying heat to the medium using the first and second thermal print heads simultaneously, sensing the first and second patterns using a sensor, calculating the distance between the first and second thermal print heads using the difference between the print positions of the sensed first and second patterns, and adjusting the alignment between the print positions of the first and second thermal print heads using the calculated distance.

The first thermal print head may print one or two of cyan, magenta and yellow, and the second thermal print head may print the remaining color(s) that the first thermal print head does not print.

To print an image, the first thermal print head may apply heat to a first side of the medium, and the second thermal print head may apply heat to a second side of the medium.

The first and second patterns may not overlap, and in printing the first and second patterns, the first and second thermal print heads may start heating the medium at a predetermined point of time and terminate heating the medium when the sensor starts sensing the printed patterns.

The step of calculating the distance may comprise detecting sensing times of the first and second patterns using an output signal of the sensor that sensed the patterns, calculating the time difference between the detected sensing times of the first and second patterns, and calculating the distance between the first and second thermal print heads by multiplying the calculated time difference by the movement speed of the medium.

In adjusting the alignment, at least one of the print start positions of the first and second thermal print heads is adjusted using the calculated distance.

According to another aspect of the present invention, a device for adjusting the alignment of an image forming apparatus using first and second thermal print heads that apply heat to a medium to print an image is provided. The device comprises a pattern print unit which prints first and second patterns by applying heat to the medium for a predetermined time period using the first and second thermal print heads simultaneously, a sensor which senses the first and second patterns, a distance calculating unit which detects the difference between the print positions of the first and second patterns using an output of the sensor and calculates the distance between the first and second thermal print heads, and an adjusting unit which adjusts the alignment between the print positions of the first and second thermal print heads using the calculated distance.

The first thermal print head may print one or two of cyan, magenta and yellow, and the second thermal print head may print the remaining color(s) that the first thermal print head does not print.

The first thermal print head may apply heat to a first side of the medium, the second thermal print head may apply heat to a second side of the medium, and the first and second patterns may be printed so as not to overlap.

The sensor may be positioned such that the distance between the sensor and whichever of the first and second print heads is closer to the sensor is smaller than the distance between the first and second thermal print heads.

To print the first and second patterns, the pattern print unit may start heating the medium at a predetermined point of time using the first and second thermal print heads, and terminate heating the medium when the sensor starts sensing the printed patterns.

The distance calculating unit may include a memory which stores the output of the sensor, a memory control unit which stores the output of the sensor in the memory, a time detecting unit which detects sensing times of the first and second patterns using the output of the sensor that is stored in the memory, a difference calculating unit which calculates the time difference between the detected sensing times of the first and second patterns, and a calculating unit which calculates the distance between the first and second thermal print heads by multiplying the calculated time difference by the movement speed of the medium.

The adjusting unit may adjust at least one of the print start positions of the first and second thermal print heads using the calculated distance.

According to still another aspect of the present invention, an image forming apparatus using first and second thermal print heads that apply heat to a medium to print an image is provided. The image forming apparatus comprises a data input unit which receives image data to be printed, a control unit which generates and outputs control signals that control the operation of the first and second thermal print heads using the image data, the first and second thermal print heads, which apply heat to the medium to print an image according to the control signals, and a sensor which senses the image printed on the medium. The control unit includes a control signal generating unit which generates control signals such that the first and second thermal print heads simultaneously apply heat to the medium for a predetermined time period to respectively print first and second patterns, a distance calculating unit which detects the difference between the print positions of the first and second patterns using an output of the sensor, and calculates the distance between the first and second thermal print heads, and an adjusting unit which adjusts the alignment between the print positions of the first and second thermal print heads using the calculated distance.

The first thermal print head may apply heat to a first side of the medium to print one or two of cyan, magenta and yellow, and the second thermal print head may apply heat to a second side of the medium to print the remaining color(s) that the first thermal print head does not print.

According to yet another aspect of the present invention, the method of adjusting the alignment of an image forming apparatus can be embodied as a computer readable recording medium having embodied thereon a computer program for executing the above-described method.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
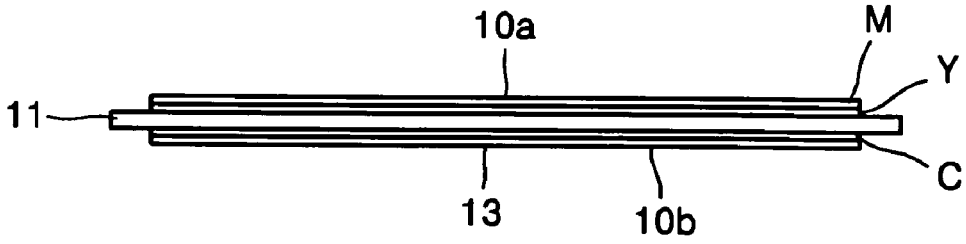
FIG. 1 (PRIOR ART)
FIG. 1 is a cross-sectional view of a typical thermal reaction medium.

FIG. 1 is a cross-sectional view of a typical thermal reaction medium. The thermal reaction medium has ink layers of predetermined colors formed on both sides, that is, a first side 10*a* and a second side 10*b*, of a base 11. The ink layers have different colors. For example, a yellow (Y) layer and a magenta (M) layer are located in that order on the first side 10*a*, and a cyan (C) layer is formed on the second side 10*b*. The base may be a transparent material. A reflection layer 13 reflects light such that a color image can be viewed through the first side 10*a*.

Figure 2:
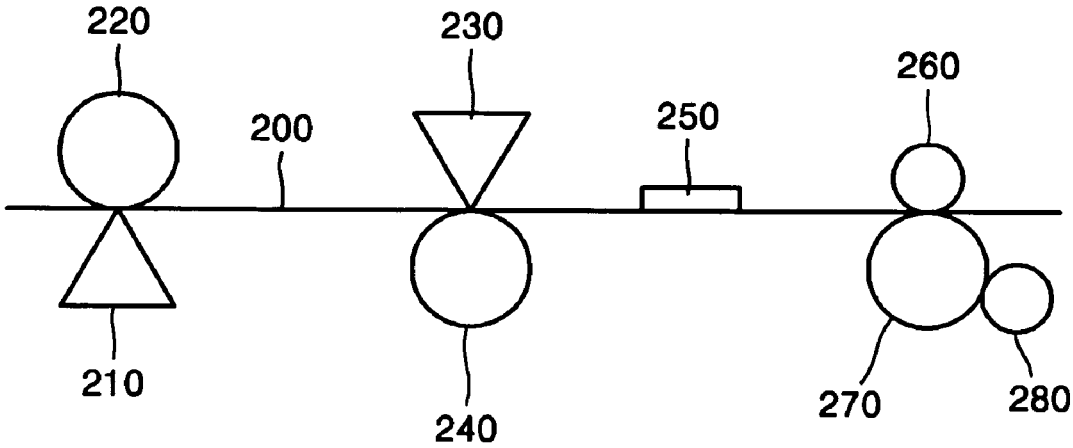
FIG. 2 is a cross-sectional view of the structure of a thermal transfer image forming apparatus having two thermal print heads.

FIG. 2 is a cross-sectional view of the structure of a thermal transfer image forming apparatus having two thermal print heads 230 and 210. The image forming apparatus includes a first thermal print head 230, a second thermal print head 210, a first platen roller 220, a second platen roller 240, a driving motor 280, a driving roller 270, an idle roller 260, and a sensor 250.

The first and second thermal print heads 230 and 210 apply heat to a medium 200 to print image data. The image data to be printed includes data regarding yellow, magenta and cyan colors, or red, green and blue colors. When the image data includes yellow, magenta and cyan data, for example, the first thermal print head 230 applies heat to the medium 200 to print the yellow and magenta data, and the second thermal print head 210 applies heat to the medium 200 to print the cyan data.

The first and second platen rollers 220 and 240 respectively face the first and second thermal print heads 230 and 210, and support the medium 200 such that the first and second thermal print heads 230 and 210 can heat the medium. The first and second platen rollers 220 and 240 rotate as the medium 200 is fed.

The driving motor 280 is a driving source to supply a medium to be printed to the first and-second thermal print heads 230 and 210, and rotates the driving roller 270 to feed the medium. While the medium is between the idle roller 260 and the driving roller 270, the slave roller 260 is engaged with the driving roller 270 and rotated. The sensor 250 senses the position of the medium 200 and the patterns printed on the medium 200. The operation of the sensor 250 will be described below in further detail.

Figure 3:
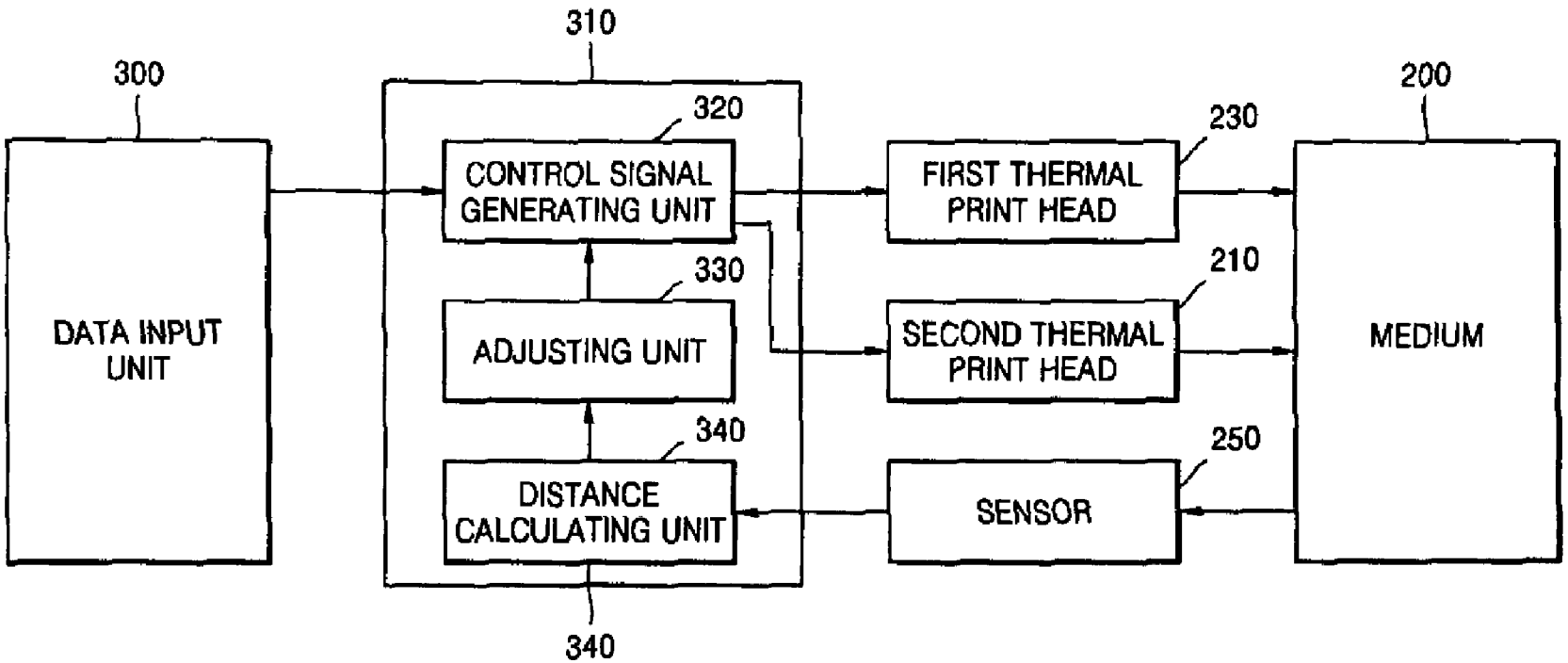
FIG. 3 is a block diagram of a thermal transfer image forming apparatus according to an exemplary embodiment of the present invention.

FIG. 3 is a block diagram of a thermal transfer image forming apparatus according to an exemplary embodiment of the present invention. The image forming apparatus includes a data input unit 300, a control unit 310, first and second thermal print heads 230 and 210, and a sensor 250. The control unit 310 includes a control signal generating unit 320, an adjusting unit 330, and a distance calculating unit 340.

The data input unit 300 receives image data to be printed from a personal computer (PC), a digital camera, a personal digital assistant, or the like.

The control unit 310 generates and outputs signals for controlling the operation of the first and second thermal print heads 230 and 210 such that first and second patterns are printed on the medium 200. The first and second thermal print heads 230 and 210 receive the control signals and print the first and second patterns on the medium 200. The sensor 250 senses the first and second patterns printed on the medium 200 and outputs the result as a signal. The control unit 310 receives the sensor output signal to calculate the distance between the first and second thermal print heads, and then adjusts the alignment of the print positions of the first and second thermal print heads 230 and 210 according to the distance between the first and second thermal print heads 230 and 210. To adjust this alignment, the second thermal print head 210 first applies heat to the medium to print a dot, and then the first thermal print head 230 preferably applies heat to the medium 200 after the medium 200 has moved as far as the calculated distance between the first and second thermal print heads 230 and 210.

After the alignment has been adjusted, the control unit 310 generates control signals according to image data input from the data input unit 300. The first and second thermal print heads 230 and 210 receive the control signals and apply heat to the medium to print an image according to the control signals.

Figure 6:
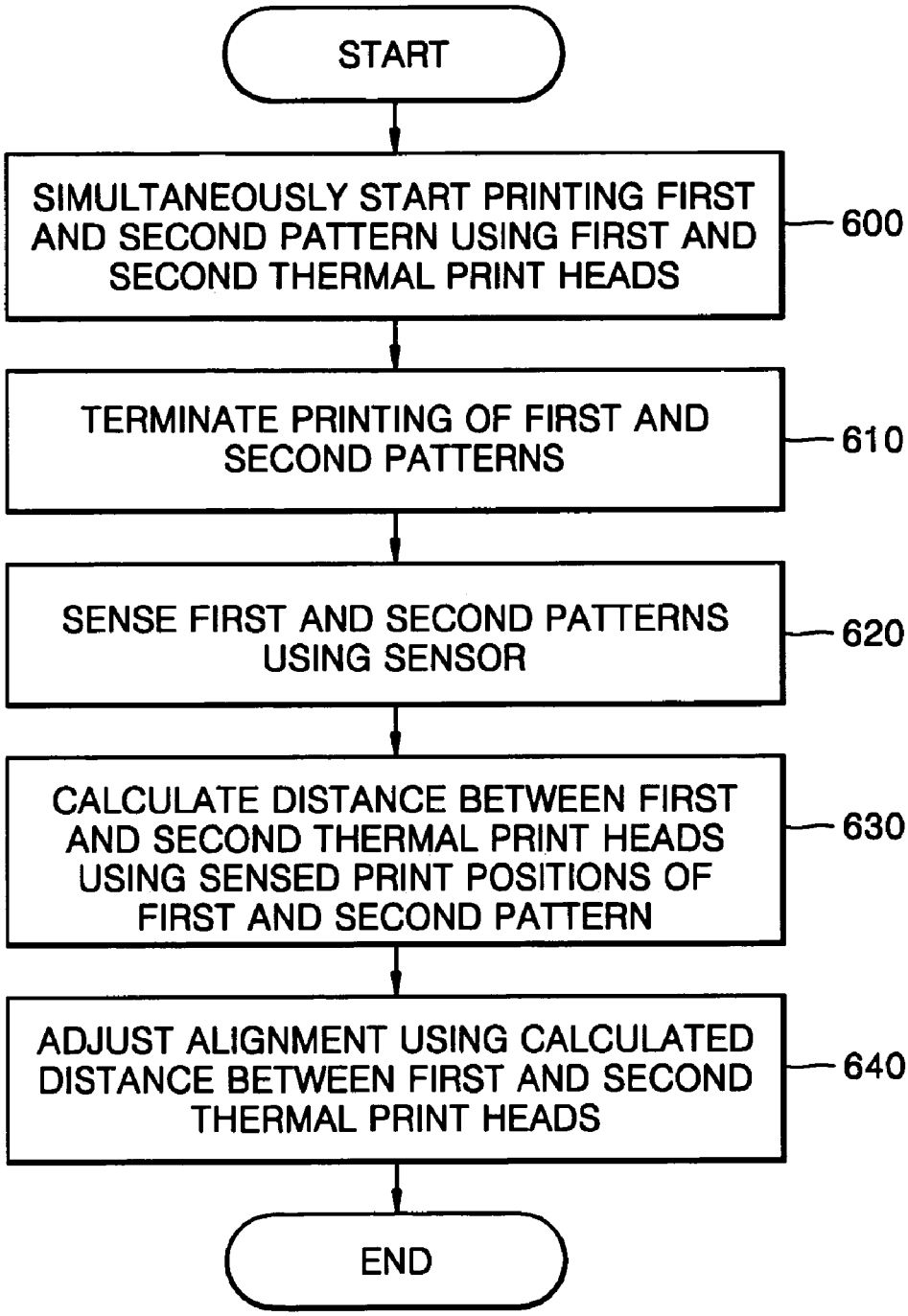
FIG. 6 is a flowchart illustrating a method of adjusting the alignment between thermal print heads according to an exemplary embodiment of the present invention.

The method of adjusting the alignment of the image forming apparatus described above will now be described in more detail with reference to FIG. 6, which is a flowchart of a method of adjusting the alignment of an image forming apparatus.

The control signal generating unit 320 generates control signals to start driving the first and second thermal print heads 230 and 210, and the first and second thermal print heads 230 and 210 receive the generated control signals and simultaneously apply heat to the medium 200 to print the first and second patterns (step 600). The control signal generating unit 320 generates control signals to terminate printing by the first and second thermal print heads 230 and 210, and each of the first and second thermal print heads 230 and 210 receives the generated control signals, and simultaneously stops heating the medium 200 (step 610).

It is preferable that the printed areas of the first and second patterns do not overlap, to allow the distance between the first and second thermal print heads to be detected using the first and second patterns. In steps 600 and 610, the start and stop times for heating the medium may be set to control the time period for which the first and second thermal print heads 230 and 210 apply heat to the medium 200 to, for example, prevent overlap of the images.

Figure 4A:
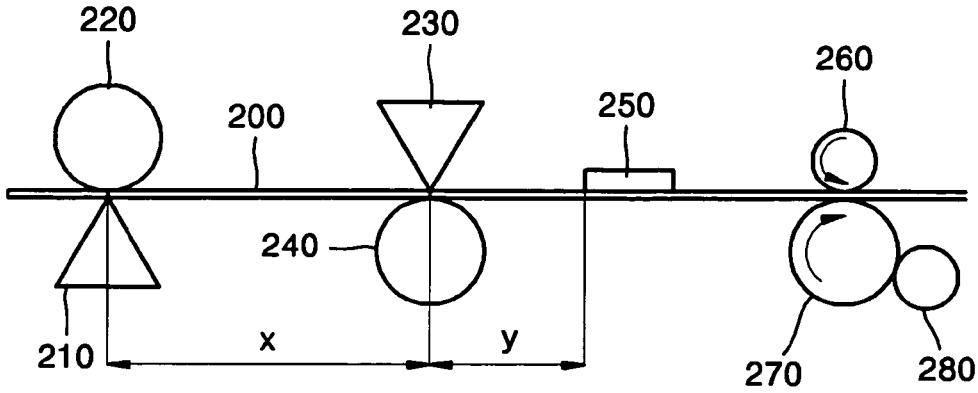
FIG. 4A shows the image forming apparatus of FIG. 3 at the point of starting to print first and second patterns according to an exemplary embodiment of the present invention.

FIG. 4A shows the point when the thermal transfer image forming apparatus of FIG. 3 starts printing patterns on the medium 200 according to an exemplary embodiment of the present invention. The first and second thermal print heads 230 and 210 simultaneously apply heat to the medium 200 at the point when the driving motor 280 starts rotating the driving roller 270 and moving the medium 200, or some time thereafter.

Figure 4B:
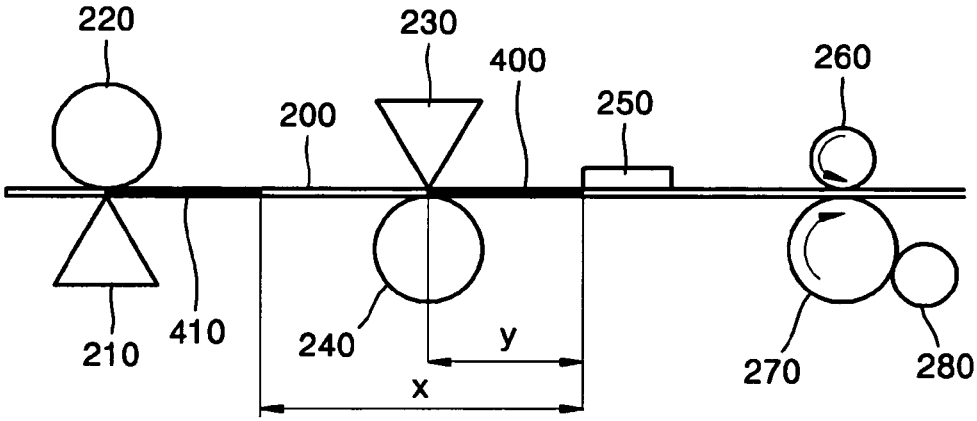
FIG. 4B shows the image forming apparatus of FIG. 3 at the point of terminating the printing of the first and second patterns according to an exemplary embodiment of the present invention.

FIG. 4B shows the point when the thermal transfer image forming apparatus of FIG. 3 stops printing the patterns on the medium 200, according to an exemplary embodiment of the present invention. The first and second thermal print heads 230 and 210 simultaneously stop printing the patterns on the medium 200 at the point when the sensor 250 starts sensing the patterns printed on the medium 200. As described above, to avoid overlapping the first pattern 400 and the second pattern 410, the distance y between the sensor 250 and the first thermal print head 230 is kept smaller than the distance x between the first and second thermal print heads 230 and 210.

Figure 4C:
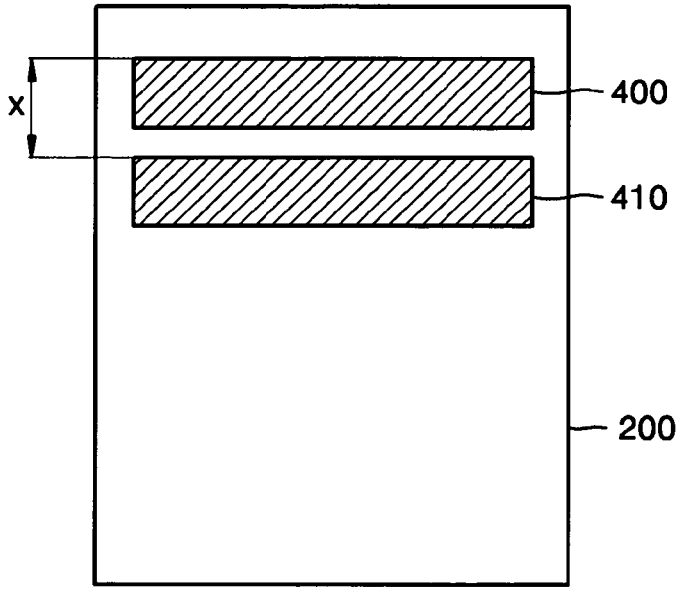
FIG. 4C shows the first and second patterns printed on the medium according to an exemplary embodiment of the present invention.

FIG. 4C shows the first pattern 400 and the second pattern 410 which are printed on the medium 200 according to an exemplary embodiment of the present invention. The distance between the start points of the first pattern 400 and the second pattern 410 is the distance between the first and second thermal print heads 230 and 210.

Referring again to FIG. 6, the sensor 250 senses the first and second patterns 400 and 410 printed on the medium 200 (step 620). The sensor 250 may sense the first and second patterns 400 and 410 after steps 600 and 610 are completed, or at the same time as steps 600 and 610 are performed.

The distance calculating unit 340 receives the sensor output signal and calculates the distance between the first and second thermal print heads 230 and 210 using the sensor output signal (step 630). The adjusting unit 330 adjusts the alignment between the print positions of the first and second thermal print heads 230 and 210 using the calculated distance between the first and second thermal print heads 230 and 210 (step 640). In step 640, the adjusting unit 330 preferably adjusts the print start positions of the first and second thermal print heads 230 and 210 according to the distance between the first and second thermal print heads 230 and 210.

Figure 5:
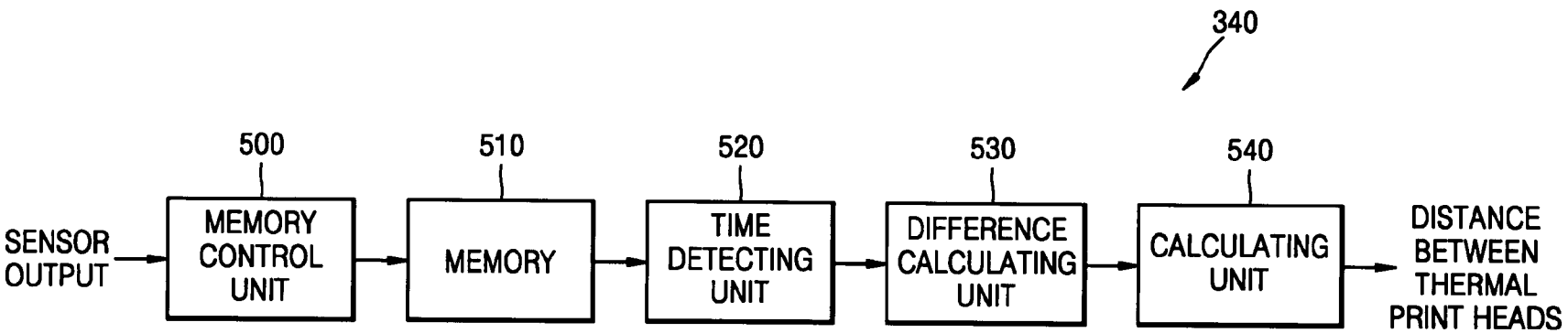
FIG. 5 is a block diagram of the distance calculating unit of FIG. 3 according to an exemplary embodiment of the present invention.
Figure 7:
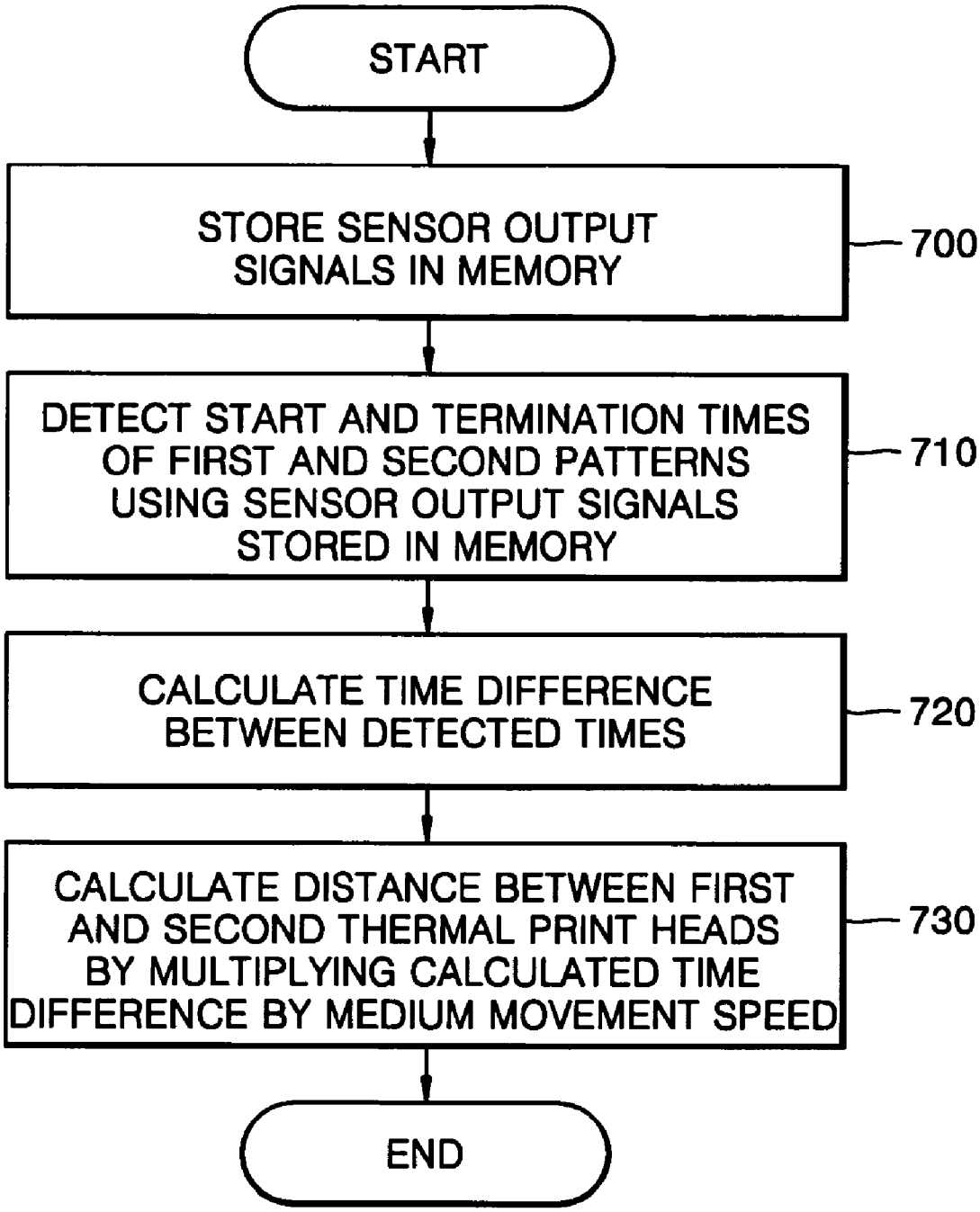
FIG. 7 is a flowchart illustrating the operation of calculating the distance between the thermal print heads of FIG. 6 according to an exemplary embodiment of the present invention.

FIG. 5 is a block diagram of the distance calculating unit 340 of FIG. 3. The distance calculating unit 340 includes a memory control unit 500, a memory 510, a time detecting unit 520, a difference calculating unit 530, and a calculating unit 540. The operation of the distance calculating unit 340 will now be described with reference to FIG. 7, which is a flowchart illustrating a method of calculating the distance between the first and second thermal print heads 230 and 210 using the sensor output signal.

The memory control unit 500 stores a signal output from the sensor 250 in the memory 510 (step 700). The time detecting unit 520 reads the sensor output signal from the memory 510 and detects the respective start times or termination times of sensing first and second patterns (step 710). The difference calculating unit 530 calculates the difference between the detected times of the first and second patterns (step 720). The difference calculating unit 530 may calculate the difference between the start times of sensing the first and second patterns, the difference between the termination times of sensing the first and second patterns, or the difference between average values of the first and second patterns.

The calculating unit 540 receives the time difference between the first and second patterns from the difference calculating unit 530, and multiplies the time difference by the movement speed of the medium 200, to calculate the distance between the first and second thermal print heads 230 and 210 (step 730).

In step 730, the calculating unit 540 may receive the sensing start time difference and the sensing termination time difference between the first and second patterns from the difference calculating unit 530, to calculate two distances between the first and second thermal print heads 230 and 210, and then average the two distances to calculate the distance between the first and second thermal print heads 230 and 210.

The invention can also be embodied as computer readable code on a computer readable recording medium. The computer readable recording medium is any data storage device that can store data which can be thereafter read by a computer system. Examples of computer readable recording mediums include read-only-memory (ROM), random-access memory (RAM), CD-ROMs, magnetic tapes, floppy disks, optical data storage devices, and carrier waves (such as data transmission through the internet). The computer readable recording medium can also be distributed over network coupled computer systems so that the computer readable code is stored and executed in a distributed fashion. Also, functional programs, code, and code segments for accomplishing the present invention can be easily construed by programmers skilled in the art to which the present invention pertains.

Although the image forming apparatus for printing an image using two or more thermal print heads has been described as an exemplary embodiment of the present invention, the present invention is applicable to any image forming apparatus that prints an image using two print heads that are positioned a predetermined distance apart.

As described above, in a method and device for adjusting the alignment of an image forming apparatus according to the present invention, the distance between two thermal print heads is accurately measured using two patterns that the thermal print heads print by simultaneously applying heat to a medium, and the alignment of the image forming apparatus is conveniently and precisely adjusted using the measured distance between the thermal print heads. Accordingly, optimum print quality can be achieved.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of adjusting the alignment of an image forming apparatus using first and second thermal print heads that apply heat to a medium to print an image, the method comprising:

printing first and second patterns by applying heat to the medium using the first and second thermal print heads simultaneously;

sensing the first and second patterns using a sensor;

calculating the distance between the first and second thermal print heads using the difference between the print positions of the sensed first and second patterns; and adjusting the alignment between the print positions of the first and second thermal print heads using the calculated distance.

2. The method of claim 1, wherein the first thermal print head prints one or two of cyan, magenta and yellow, and the second thermal print head prints the remaining color(s) that the first thermal print head does not print.

3. The method of claim 1, wherein to print an image, the first thermal print head applies heat to a first side of the medium, and the second thermal print head applies heat to a second side of the medium.

4. The method of claim 1, wherein, in printing the first and second patterns, the first and second thermal print heads start heating the medium at a predetermined point of time and terminate heating the medium when the sensor starts sensing the printed patterns.

5. The method of claim 1, wherein calculating the distance comprises:

detecting sensing times of the first and second patterns using an output signal of the sensor that sensed the patterns;

calculating the time difference between the detected sensing times of the first and second patterns; and calculating the distance between the first and second thermal print heads by multiplying the calculated time difference by the movement speed of the medium.

6. The method of claim 5, wherein the sensing time of the pattern is one of the sensing start time, the sensing termination time, and a middle value of the sensing start time and the sensing termination time.

7. The method of claim 1, wherein, in adjusting the alignment, at least one of the print start positions of the first and second thermal print heads is adjusted using the calculated distance.

8. A computer readable recording medium having embodied thereon a computer program for executing a method comprising the steps of:

printing first and second patterns by applying heat to a printable medium using first and second thermal print heads simultaneously;

sensing the first and second patterns using a sensor;

calculating the distance between the first and second thermal print heads using the difference between the print positions of the sensed first and second patterns; and adjusting the alignment between the print positions of the first and second thermal print heads using the calculated distance.

9. A device for adjusting the alignment of an image forming apparatus using first and second thermal print heads that apply heat to a medium to print an image, the device comprising:

a pattern print unit which prints first and second patterns by applying heat to the medium for a predetermined time period using the first and second thermal print heads simultaneously;

a sensor which senses the first and second patterns;

a distance calculating unit which detects the difference between the print positions of the first and second patterns using an output of the sensor and calculates the distance between the first and second thermal print heads; and an adjusting unit which adjusts the alignment between the print positions of the first and second thermal print heads using the calculated distance.

10. The device of claim 9, wherein the first thermal print head prints one or two of cyan, magenta and yellow, and the second thermal print head prints the remaining color(s) that the first thermal print head does not print.

11. The device of claim 9, wherein the first thermal print head applies heat to a first side of the medium, and the second thermal print head applies heat to a second side of the medium.

12. The device of claim 9, wherein the sensor is positioned such that the distance between the sensor and whichever of the first and second print heads is closer to the sensor is smaller than the distance between the first and second thermal print heads.

13. The device of claim 9, wherein to print the first and second patterns, the pattern print unit starts heating the medium at a predetermined point of time using the first and second thermal print heads, and terminates heating the medium when the sensor starts sensing the printed patterns.

14. The device of claim 9, wherein the distance calculating unit includes:

a memory which stores the output of the sensor;

a memory control unit which stores the output of the sensor in the memory;

a time detecting unit which detects sensing times of the first and second patterns using the output of the sensor that is stored in the memory;

a difference calculating unit which calculates the time difference between the detected sensing times of the first and second patterns; and a calculating unit which calculates the distance between the first and second thermal print heads by multiplying the calculated time difference by the movement speed of the medium.

15. The device of claim 14, wherein the sensing time of the pattern is one of the sensing start time, the sensing termination time, and a middle value of the sensing start time and the sensing termination time.

16. The device of claim 9, wherein the adjusting unit adjusts at least one of the print start positions of the first and second thermal print heads using the calculated distance.

17. An image forming apparatus for printing an image on a medium, the image forming apparatus comprising:

a data input unit which receives image data to be printed;

first and second thermal print heads, which apply heat to the medium to print an image;

a sensor which senses the image printed on the medium; and a control unit which generates and outputs control signals that control the operation of the first and second thermal print heads using the image data, the control unit comprising:

a control signal generating unit which generates control signals such that the first and second thermal print heads simultaneously apply heat to the medium for a predetermined time period to respectively print first and second patterns;

a distance calculating unit which detects the difference between the print positions of the first and second patterns using an output of the sensor, and calculates the distance between the first and second thermal print heads; and an adjusting unit which adjusts the alignment between the print positions of the first and second thermal print heads using the calculated distance.

18. The image forming apparatus of claim 17, wherein the first thermal print head applies heat to a first side of the medium to print one or two of cyan, magenta and yellow, and the second thermal print head applies heat to a second side of the medium to print the remaining color(s) that the first thermal print head does not print.

* * * * *